US010492587B2

(12) United States Patent
Kudo

(10) Patent No.: US 10,492,587 B2
(45) Date of Patent: Dec. 3, 2019

(54) ROD-SHAPED COSMETIC MATERIAL FEEDING CONTAINER

(71) Applicant: TOKIWA CORPORATION, Gifu (JP)

(72) Inventor: Saori Kudo, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 0 days.

(21) Appl. No.: 16/123,592

(22) Filed: Sep. 6, 2018

(65) Prior Publication Data

US 2019/0075909 A1 Mar. 14, 2019

(30) Foreign Application Priority Data

Sep. 8, 2017 (JP) ..... 2017-173047

(51) Int. Cl.

| | |
|---|---|
| ***A45D 40/04*** | (2006.01) |
| ***B43K 21/08*** | (2006.01) |
| ***A45D 40/20*** | (2006.01) |
| *A45D 40/00* | (2006.01) |

(52) U.S. Cl.

CPC ..... *A45D 40/205* (2013.01); *A45D 40/04* (2013.01); *A45D 2040/0025* (2013.01); *A45D 2040/208* (2013.01); *A45D 2200/1072* (2013.01); *B43K 21/08* (2013.01)

(58) Field of Classification Search

CPC ..... B43K 21/02; B43K 21/08; A45D 40/20; A45D 40/205; A45D 40/04

USPC ..... 401/55, 68–75

See application file for complete search history.

(56) References Cited

FOREIGN PATENT DOCUMENTS

| | | |
|---|---|---|
| JP | 64-8317 | 1/1989 |
| JP | 3196621 | 3/2015 |

*Primary Examiner* — David J Walczak
*Assistant Examiner* — Joshua R Wiljanen
(74) *Attorney, Agent, or Firm* — Greenblum & Bernstein, P.L.C.

(57) ABSTRACT

A plurality of support pieces disposed at a supporting part support a plurality of rod-shaped cosmetic materials arranged side by side in a container. The plurality of rod-shaped cosmetic materials are configured to simultaneously advance and retreat in an axial direction together with the supporting part and the plurality of rod-shaped cosmetic materials are configured to appear and disappear from a leading tube. The plurality of rod-shaped cosmetic materials are individually supported by the one shared support piece.

14 Claims, 8 Drawing Sheets

ROD-SHAPED COSMETIC MATERIAL FEEDING CONTAINER

TECHNICAL FIELD

The present invention relates to a rod-shaped cosmetic material feeding container that allows a rod-shaped cosmetic material to appear and disappear.

BACKGROUND ART

Conventionally, as a rod-shaped cosmetic material feeding container, there has been widely known a rod-shaped cosmetic material feeding container described in the following Patent Literature 1. This rod-shaped cosmetic material feeding container described in Patent Literature 1 is a so-called cosmetic material pencil that internally houses a rod-shaped cosmetic material. A user can cause the rod-shaped cosmetic material to appear and disappear from an opening at a tip of the container as necessary, and thus the rod-shaped cosmetic material can be provided for use. With such rod-shaped cosmetic material feeding container, for example, when the cosmetic material is applied over an applied portion such as an eyebrow, a thin rod-shaped cosmetic material requires the application over and over again and therefore takes the time, causing a problem of inefficiency. Meanwhile, with a thick rod-shaped cosmetic material, a cosmetic material heavily attaches in a wide range, causing a problem of failing to put on a fine, dainty makeup.

A cosmetic material applicator as described in the following Patent Literature 2 has been known as a cosmetic material applicator that handles the makeup as described above. The cosmetic material applicator feeds liquid cosmetic material in a container to a tip through a core material made of fiber and performs an application on an eyebrow at the core material tip. With this Patent Literature 2, notches are formed at the tip of the core material, and this tip has, for example, a saw-tooth shape. Since the tip of the core material is split so as to form a teeth shape with this Patent Literature 2, fine, dainty makeup is possible, and the use of the plurality of teeth allows efficient application. Further, the teeth shape also allows the makeup while an eyebrow is combed.

CITATION LIST

Patent Literature

Patent Literature 1: Japanese Unexamined Utility Model Application Publication No. 64-8317

Patent Literature 2: Japanese Registered Utility Model No. 3196621

TECHNICAL PROBLEM

However, while the cosmetic material applicator using the liquid cosmetic material described in Patent Literature 2 has the above-described excellent features, the cosmetic material applicator has a following problem: Since the liquid cosmetic material is applied with the core material tip after, for example, a foundation for base, a cosmetic material of the foundation or the like may enters between the fibers. This causes a clogging of the core material in use over time, and the liquid cosmetic material becomes blurred during the application, causing a problem that an applied portion cannot be applied well. That is, the cosmetic material applicator of Patent Literature 2 has the problem that a liquid cosmetic product cannot be applied over an eyebrow well.

Therefore, an object of the present invention is to provide a rod-shaped cosmetic material feeding container that allows an efficient application of a cosmetic material when the cosmetic material is applied over an applied portion such as an eyebrow, also allows a selective, fine makeup, and further always allows a proper application without causing, for example, a clogging of the cosmetic material and without a blur of the cosmetic material.

SUMMARY OF INVENTION

A rod-shaped cosmetic material feeding container according to the present invention includes a tubular container, a movable body, and a female screw member. The tubular container has a front portion of the container and a rear portion of the container. The movable body is configured to be unrotatable around an axis line and movable in an axial direction with respect to the front portion of the container. The movable body includes a supporting part configured to support a rod-shaped cosmetic material at a tip. The movable body further includes a male screw at an outer peripheral portion. The female screw member is configured to be rotatable around the axis line with respect to the front portion of the container. The female screw member includes a female screw for screw engagement with the male screw at an inner peripheral portion. Relative rotation of the front portion of the container and the rear portion of the container causes a screwing action by the male screw and the female screw. The screwing action causes the movable body to advance and retreat, whereby the rod-shaped cosmetic material appears and disappears from an opening at the tip of the container. The supporting part includes a plurality of support pieces. The plurality of support pieces supports rear portions of the plurality of rod-shaped cosmetic materials from a peripheral area. The supporting part arranges the plurality of rod-shaped cosmetic materials side by side such that axis centers of the plurality of rod-shaped cosmetic materials are parallel to one another while the plurality of rod-shaped cosmetic materials are separated from one another. The front portion of the container has rod-shaped cosmetic material holes and a supporting part hole. The rod-shaped cosmetic material holes are configured such that the plurality of rod-shaped cosmetic materials advance and retreat through the rod-shaped cosmetic material holes. The supporting part hole is configured such that the supporting part including the support pieces advances and retreats through the supporting part hole. The opening is disposed corresponding to the plurality of rod-shaped cosmetic material holes. The support pieces individually support the plurality of rod-shaped cosmetic materials.

According to such rod-shaped cosmetic material feeding container, the plurality of support pieces, which are disposed at the supporting part, support the plurality of rod-shaped cosmetic materials arranged side by side in the container. Additionally, the plurality of rod-shaped cosmetic materials simultaneously advance and retreat in the axial direction together with the supporting part and the plurality of rod-shaped cosmetic materials are configured to appear and disappear from the opening at the tip of the leading tube, thus provided for the application. Therefore, when the cosmetic material is applied over an applied portion such as an eyebrow, the plurality of rod-shaped cosmetic materials allow the efficient application of the cosmetic material, and, for example, the one rod-shaped cosmetic material ensures selective, fine makeup. Moreover, the rod-shaped cosmetic materials do not cause, for example, a clogging of the cosmetic material such as liquid cosmetic material, and the cosmetic material does not become blurred and is always properly applicable.

In order to preferably produce the above described operations, specifically, the following configuration can be listed. The support pieces have inner surfaces as support piece surfaces. The support piece surfaces support a part of outer surfaces of the rod-shaped cosmetic materials. One support piece has one support piece surface that supports a part of an outer surface of one rod-shaped cosmetic material and another support piece surface that supports a part of an outer surface of another rod-shaped cosmetic material adjacent to the one rod-shaped cosmetic material. According to this configuration, the one support piece is configured to individually support the plurality of adjacent rod-shaped cosmetic materials.

Further, the supporting part includes the base parts, the coupling parts, and the plurality of support pieces. The respective rod-shaped cosmetic materials bump against the base parts. The coupling parts couple the adjacent base parts together. The plurality of support pieces extend forward from the outer surfaces of the base parts and the coupling parts. The base parts are configured to advance and retreat through the rod-shaped cosmetic material holes, the support pieces and the coupling parts are configured to advance and retreat through the supporting part hole, and the base parts are coupled to one another via the coupling parts; therefore, the strength of the supporting part is allowed to be increased.

The opening on the front portion of the container preferably has a shape corresponding to a shape of the rod-shaped cosmetic material holes arranged by a count identical to a count of rod-shaped cosmetic materials supported by the support pieces. The rod-shaped cosmetic material holes have an approximately similar shape to an outer shape of the rod-shaped cosmetic materials. When such configuration is employed, the rod-shaped cosmetic material is not limited to have a columnar shape but is also applicable to a rod-shaped cosmetic material having a non-circular cross-sectional shape such as an ellipsoidal cross-sectional surface.

The plurality of rod-shaped cosmetic material holes are preferably coupled to one another via clearances at the opening. The use of such configuration allows disposing the rod-shaped cosmetic materials as close to each other as possible (that is, disposing the rod-shaped cosmetic materials in a state where the clearances are provided to the extent so as not to bring the rod-shaped cosmetic materials in contact with one another). For example, when the cosmetic material is applied over an eyebrow or a similar part, the cosmetic material can be drawn densely to the hair of the eyebrow. In the case where the rod-shaped cosmetic materials are in contact with one another and an application as one rod-shaped cosmetic material is performed, the makeup possibly finishes like daubing. However, since the clearances are interposed between the mutual rod-shaped cosmetic materials as described above, this embodiment ensures preventing a sense of daubing.

The plurality of rod-shaped cosmetic materials configured to have individually different colors ensures easily forming color unevenness where colors are not uniform on the applied portion.

Here, in the case where the makeup is put on the eyebrow with one thin eyebrow pencil, putting on the makeup on the entire eyebrow requires the time. When the makeup is put on the eyebrow with the one thick rod-shaped cosmetic material, the makeup looks like being filled, requiring the technique and the time to put on the fine, dainty makeup. However, with the present invention, since the plurality of eyebrow pencils can be simultaneously used, application clearances like the eyebrow with naturally partial fallen out can be easily generated. Accordingly, the dainty and beautiful application while drawing the natural eyebrow can be performed in a short time.

Advantageous Effects of Invention

With the present invention, when a cosmetic material is applied over the applied portion such as an eyebrow, the plurality of rod-shaped cosmetic materials allow the efficient application of the cosmetic material, and, for example, the one rod-shaped cosmetic material ensures selective, fine makeup. Moreover, the rod-shaped cosmetic materials do not cause, for example, a clogging of the cosmetic material such as the liquid cosmetic material, and the cosmetic material does not become blurred and is always properly applicable.

DESCRIPTION OF EMBODIMENTS

A preferred embodiment of a rod-shaped cosmetic material feeding container according to the present invention will be described below with reference to FIG. 1 to FIG. 8.

Figure 1:
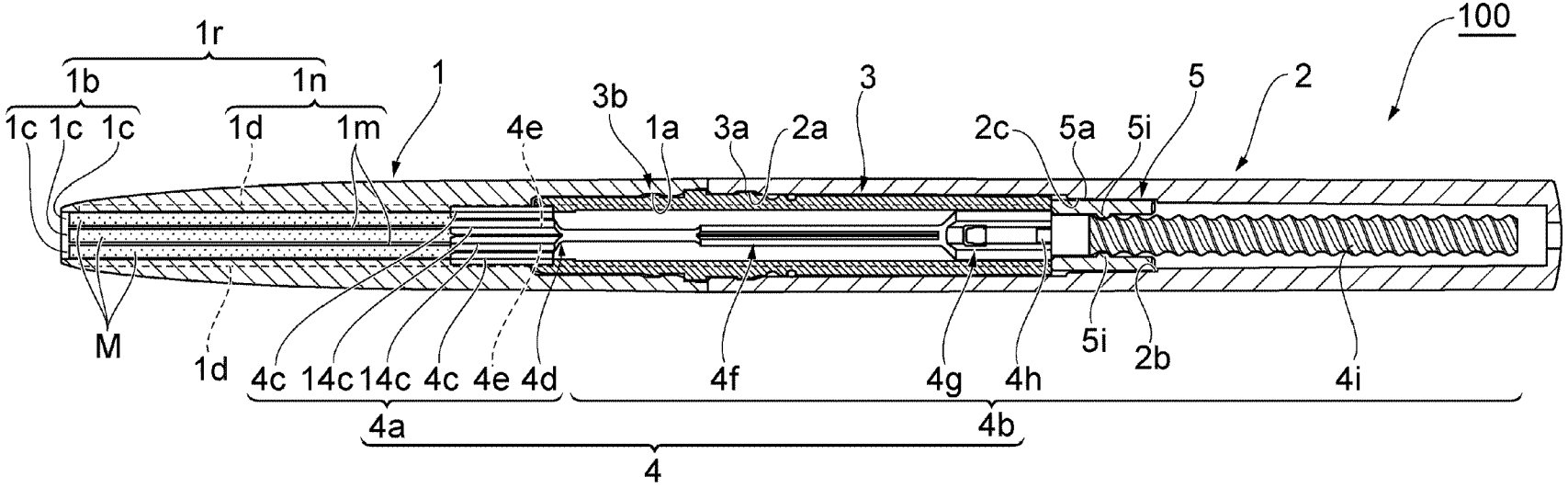
FIG. 1 is a vertical cross-sectional view of a rod-shaped cosmetic material feeding container according to an embodiment of the present invention and is a drawing illustrating a state of a movable body being positioned at a retreating limit.
Figure 2:
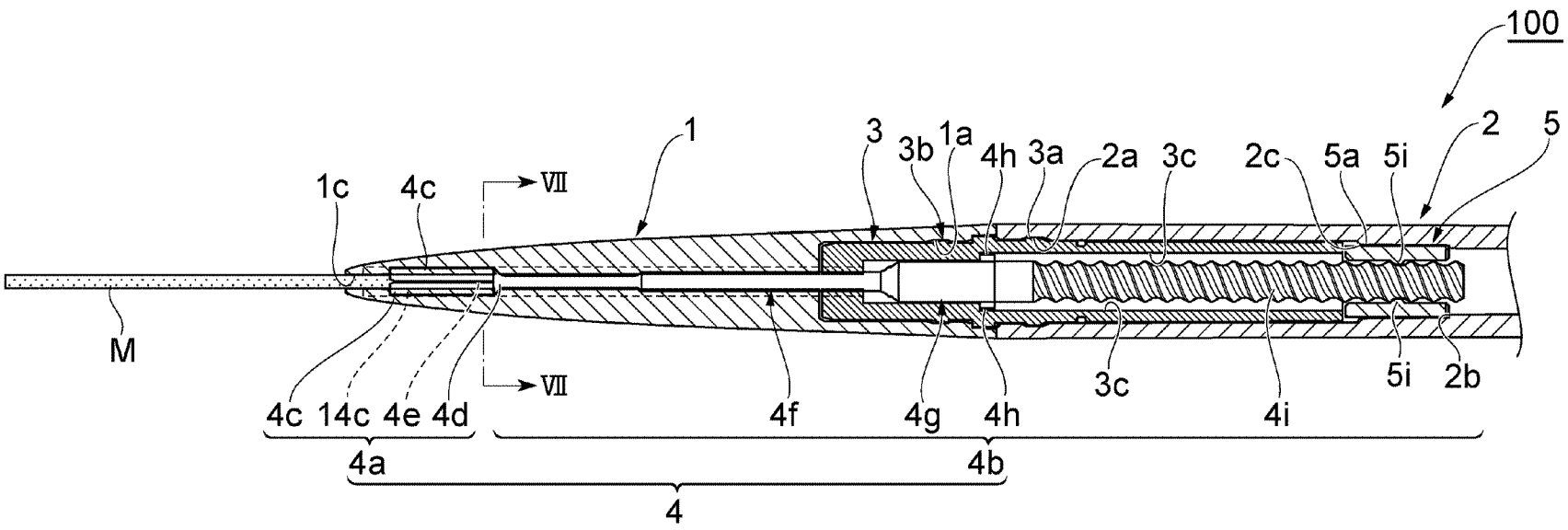
FIG. 2 is a vertical cross-sectional view of the rod-shaped cosmetic material feeding container in a direction perpendicular to FIG. 1 and is a drawing illustrating a state of the movable body being positioned at an advance limit.
Figure 3:
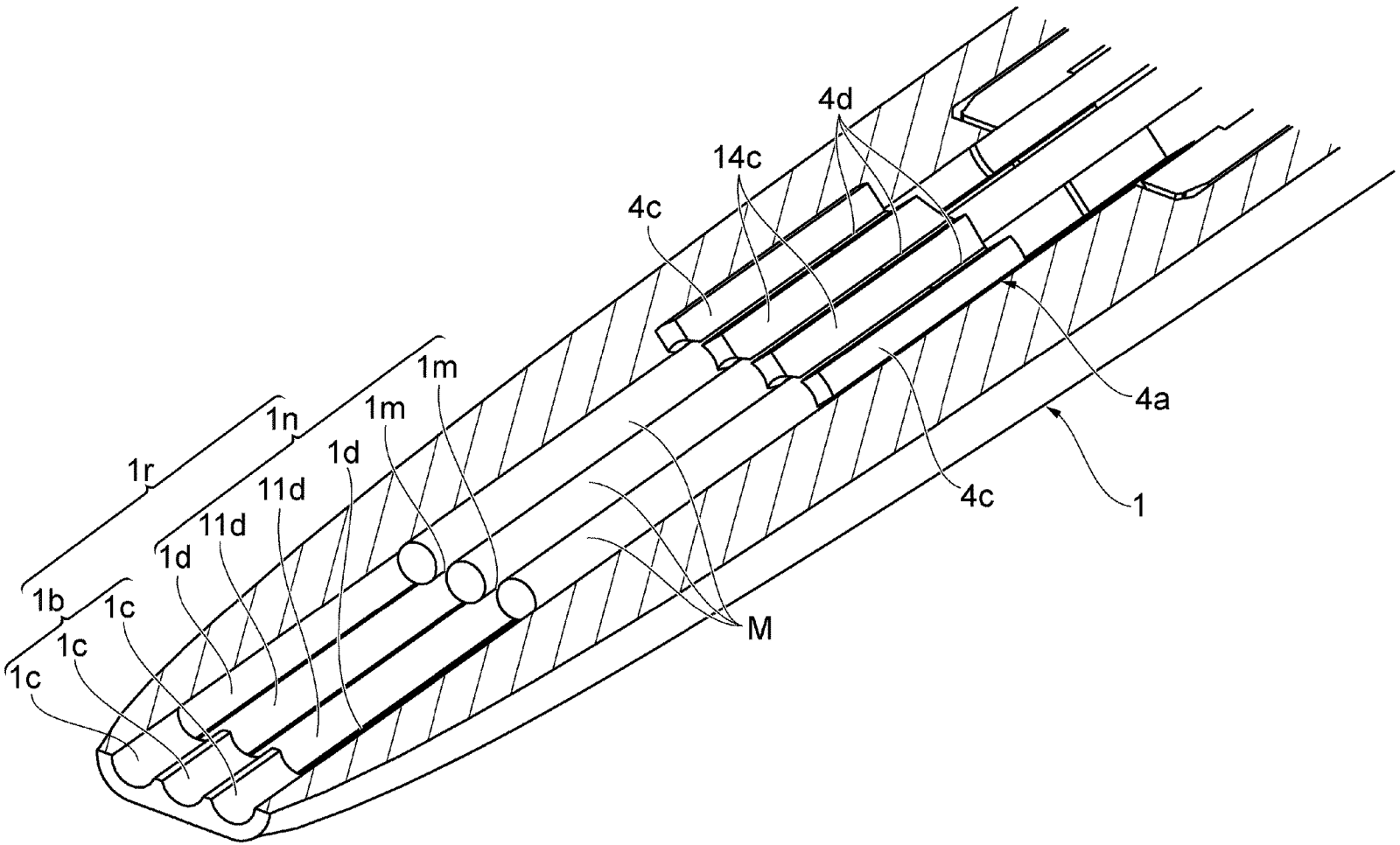
FIG. 3 is a perspective view illustrating a broken tip side of the rod-shaped cosmetic material feeding container.
Figure 4:
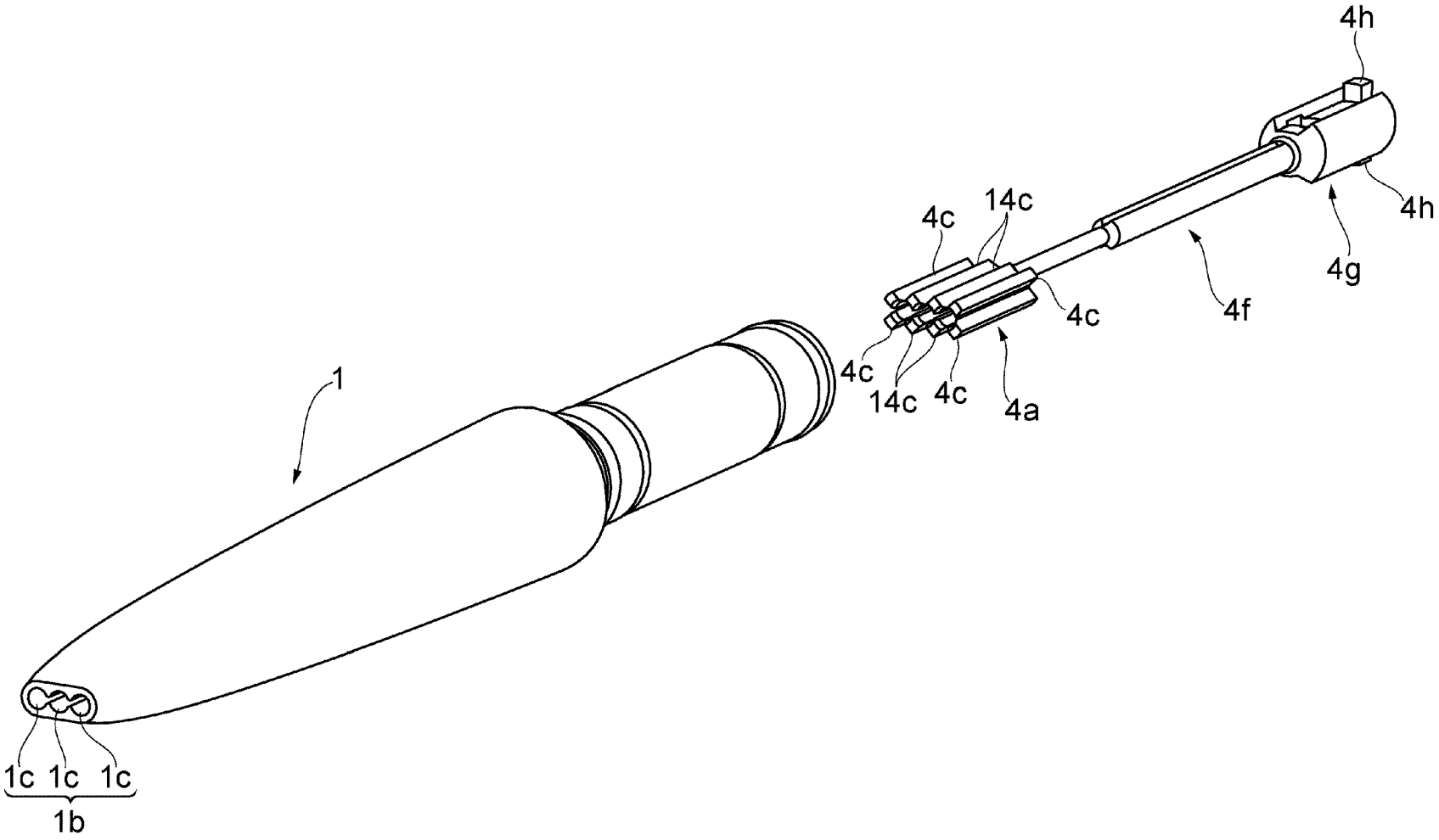
FIG. 4 is an exploded perspective view illustrating main parts of a leading tube and the movable body.
Figure 5:
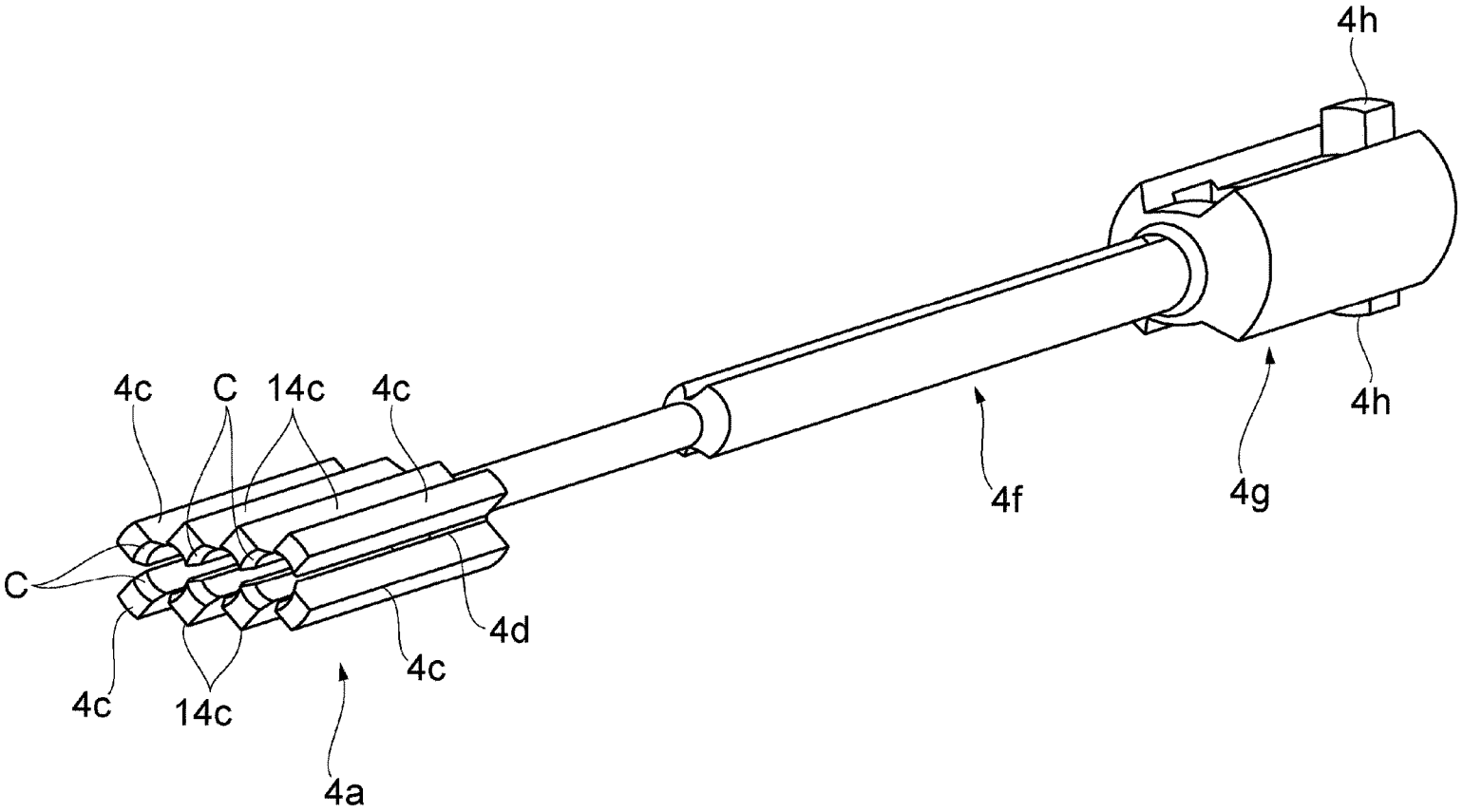
FIG. 5 is a perspective view illustrating a main part of the movable body.
Figure 6:
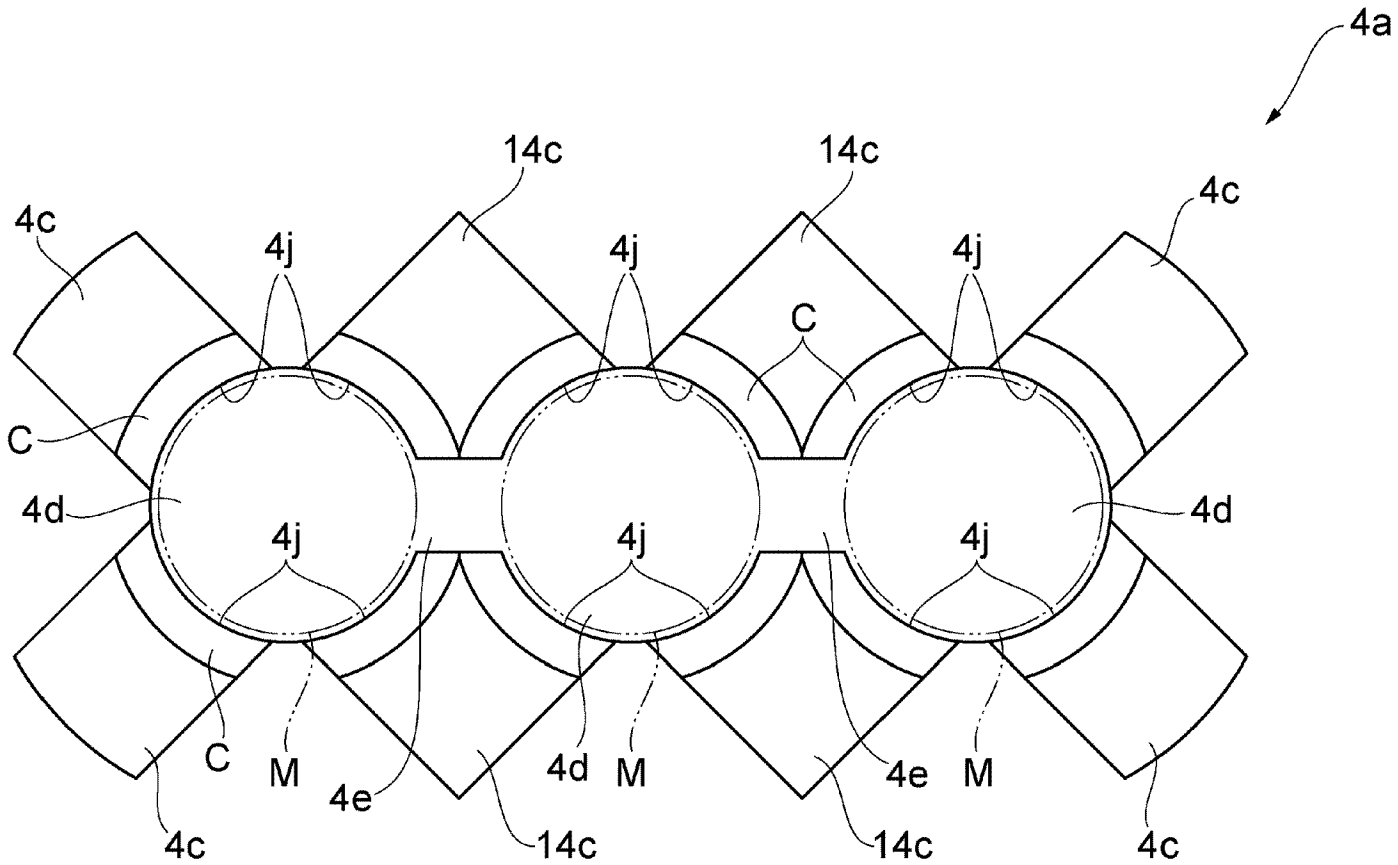
FIG. 6 is a front view of a support part.
Figure 7:
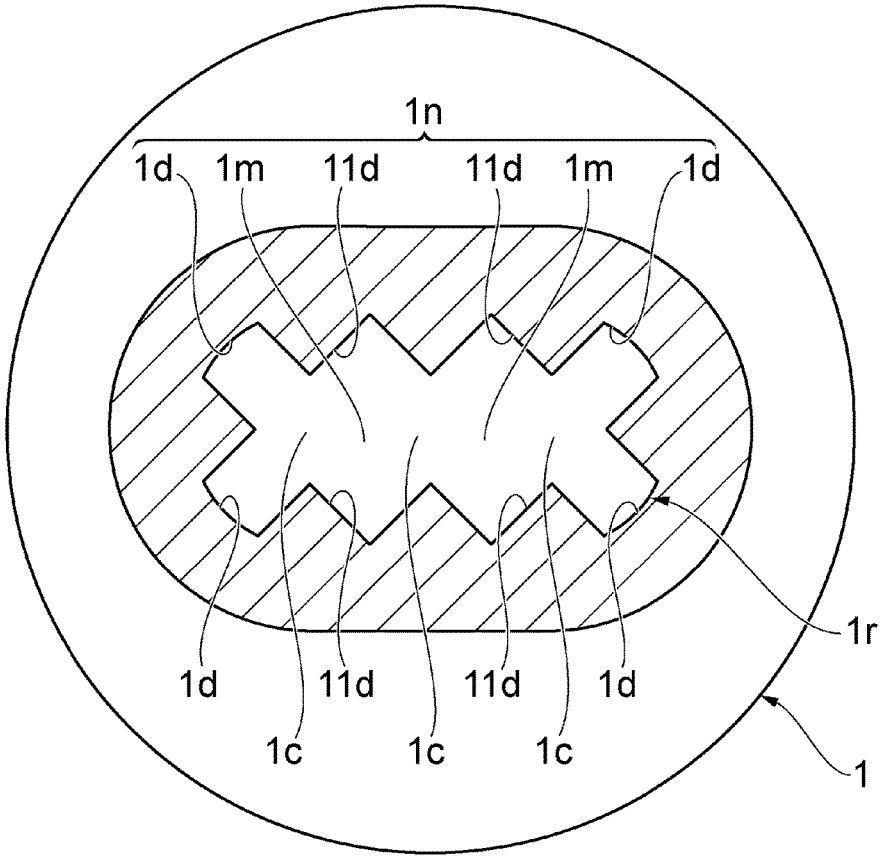
FIG. 7 is a transverse sectional view along a line VII-VII of FIG. 2 and is a drawing illustrating an advance/retreat hole in the leading tube.
Figure 8:
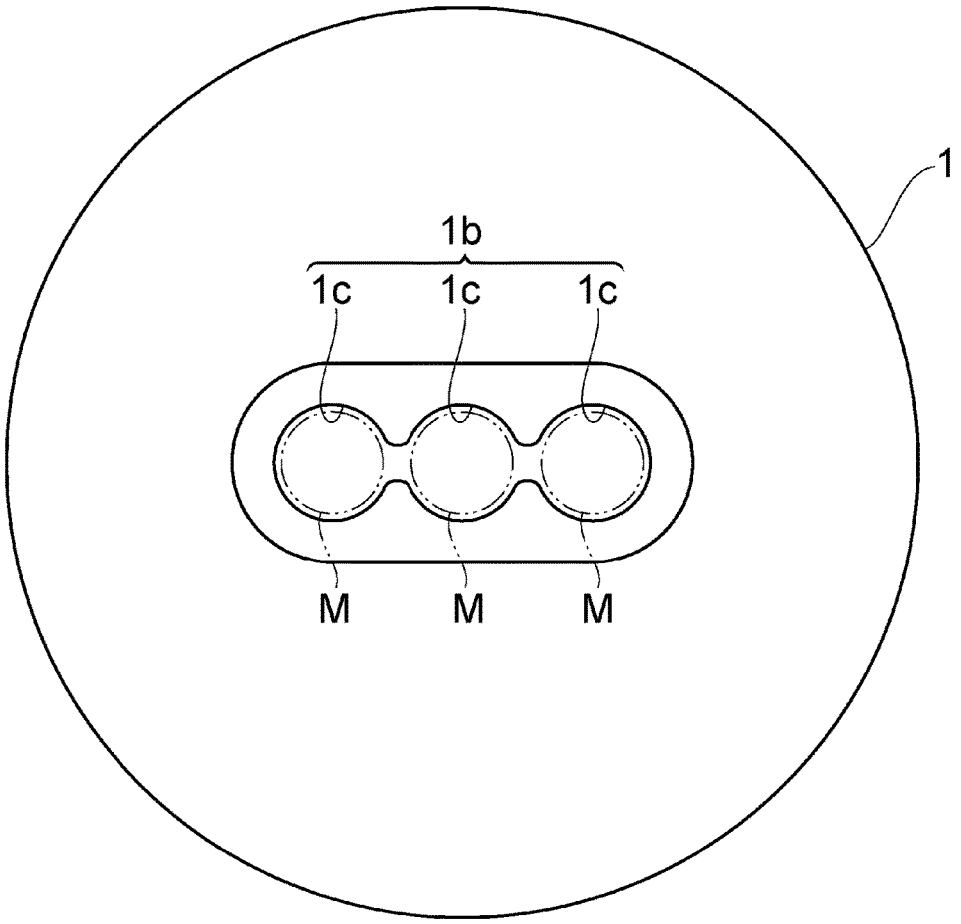
FIG. 8 is a front view of the leading tube.

FIG. 1 is a vertical cross-sectional view of a rod-shaped cosmetic material feeding container according to an embodiment of the present invention and is a drawing illustrating a state of a movable body being positioned at a retreating limit. FIG. 2 is a vertical cross-sectional view of the rod-shaped cosmetic material feeding container in a direction perpendicular to FIG. 1 and is a drawing illustrating a state of the movable body being positioned at an advance limit. FIG. 3 is a perspective view illustrating a broken tip side of the rod-shaped cosmetic material feeding container. FIG. 4 is an exploded perspective view illustrating main parts of a leading tube and the movable body. FIG. 5 is a perspective view illustrating a main part of the movable body. FIG. 6 is a front view of a support part. FIG. 7 is a transverse sectional view along a line VII-VII of FIG. 2 and is a drawing illustrating an advance/retreat hole in the leading tube. FIG. 8 is a front view of the leading tube. The rod-shaped cosmetic material feeding container of this embodiment allows a user to appropriately apply a plurality of rod-shaped cosmetic materials housed inside the rod-shaped cosmetic material feeding container over an applied portion. Here, a rod-shaped cosmetic material M is configured to be a column-shaped eyebrow pencil to draw an eyebrow as especially preferable.

As illustrated in FIG. 1 and FIG. 2, a rod-shaped cosmetic material feeding container 100 has a rounded bar shape whose overall shape is elongate like a writing material. The rod-shaped cosmetic material feeding container 100 is a tubular container whose appearance is configured by a leading tube 1 constituting a front portion of the container and a holder tube 2 constituting a rear portion of the container. These leading tube 1 and holder tube 2 internally house a joint 3, which constitutes the front portion of the container, the rod-shaped cosmetic materials M, a long rod-shaped cosmetic material supporting body 4, which supports the rod-shaped cosmetic materials M and is a movable body including a male screw 4*i*, and a female screw member 5 including female screws 5*i*. The inside of the rod-shaped cosmetic material feeding container 100 is configured such that the joint 3 and the female screw member 5, which are disposed from the front to the rear, are interposed between the rear half portion of the leading tube 1 and the front half portion of the holder tube 2.

Especially, in this embodiment, the leading tube 1 internally houses the plurality of (three pieces here) rod-shaped cosmetic materials M. The three rod-shaped cosmetic materials M are mounted and supported to the tip side of the rod-shaped cosmetic material supporting body 4 so as to ensure appearing and disappearing from the leading tube 1.

The following describes features of the rod-shaped cosmetic material feeding container 100 in detail.

The holder tube 2 is made of, for example, ABS, and has a long cylindrical shape with a closed bottom. Thus, the holder tube 2 is provided to be held by a user's fingers during the application. The joint 3 having an approximately cylindrical shape is made of, for example, ABS, and is housed inside ranging from the leading tube 1 to the holder tube 2. The female screw member 5 having an approximately cylindrical shape is made of, for example, PE and includes screw projections 5*i* and 5*i* as female screws opposed to one another at an inner peripheral portion around the middle in an axial direction.

The female screw member 5 and the joint 3 are inserted into the holder tube 2. When an engagement part 2*a*, which is disposed at the inner peripheral surface on the tip side of the holder tube 2, is engaged with an engagement part 3*a*, which is disposed at the outer peripheral surface around the middle in the axial direction of the joint 3, in the axial direction, the joint 3 is mounted to the holder tube 2 to be rotatable around the axis line and unmovable in the axial direction. The female screw member 5 is interposed between a stepped surface 2*b*, which is disposed at the inner peripheral surface of the holder tube 2, and the rear end surface of the joint 3. The female screw member 5 includes an engagement part 5*a* disposed at the outer surface of the female screw member 5. The engagement part 5*a* is engaged with an engagement part 2*c*, which is disposed at the outer peripheral surface around the middle in the axial direction of the holder tube 2, in the rotation direction. Thus, the female screw member 5 is mounted to the holder tube 2 to be unrotatable (synchronously rotatable) around the axis line.

The leading tube 1 is made of, for example, ABS and has a tapered cylindrical shape. The tip end of the joint 3 projecting forward from the holder tube 2 enters into the rear portion of the leading tube 1. An engagement part 1*a*, which is disposed at the inner peripheral surface on the rear portion side of the leading tube 1, is fitted to an engagement part 3*b*, which is disposed at the outer peripheral surface at the tip end of the joint 3. The joint 3 is thus integrally mounted to the leading tube 1 so as to be unrotatable around the axis line and unmovable in the axial direction.

The rod-shaped cosmetic material supporting body 4, which advances and retreats the inside of the container, includes a supporting part 4*a* (see also FIG. 4 and FIG. 5) to support the rear end portions of the plurality of rod-shaped cosmetic materials M and a shaft body part 4*b* disposed rearward with respect to the supporting part 4*a*. The shaft body part 4*b*, which is a shaft body extending in the axial direction, includes a coupling shaft part 4*f* coupled to the supporting part 4*a*, a rotation stopper 4*g*, which is installed consecutively to the rear portion of the coupling shaft part 4*f*, and the male screw 4*i*, which extends rearward from the rotation stopper 4*g* and is disposed at the outer peripheral portion. The male screw 4*i* is, for example, made of POM and is press-fitted to be fixed to the rotation stopper 4*g* disposed forward with respect to this male screw 4*i*. A part forward with respect to the male screw 4*i* of the rod-shaped cosmetic material supporting body 4 is, for example, made of PBT.

As illustrated in FIG. 1, FIG. 2, and FIG. 6, the supporting part 4*a* includes column-shaped base parts 4*d*. The base part 4*d* has a circular shape in cross section whose outer shape approximately matching the outer shape of the rod-shaped cosmetic material M and extends short in the axial direction. The rear end surface of the rod-shaped cosmetic material M are bumped against the base part 4*d*.

Here, three pieces of the base parts 4*d* are separately arranged side by side in a line. The mutual base parts 4*d* are coupled to each other via coupling parts 4*e* having an approximately rectangular parallelepiped shape. The coupling part 4*e* has a length in the axial direction identical to that of the base part 4*d* and a width slightly narrower than that of the base part 4*d* (narrower in the vertical direction of FIG. 6).

Block-shaped support pieces 4*c* and 14*c* (distinction between the support pieces 4*c* and 14*c* will be described later) are disposed so as to extend forward in the axial direction from the outer peripheral surfaces of the base parts 4*d* (see also FIG. 5). The block-shaped support pieces 4*c* and 14*c* are to support the rod-shaped cosmetic materials M and are disposed on the outer peripheral surfaces of these base parts 4*d* at four positions approximately equally spaced in the circumferential direction of the base parts 4*d*. The support pieces 4*c* and 14*c* extend so as to project forward from the base parts 4*d*. The inner peripheral surfaces of the support pieces 4*c* and 14*c* have an arc shape matching a part of the outer peripheral surface of the rod-shaped cosmetic material M and function as support piece surfaces 4*j* (see FIG. 6) that support the rod-shaped cosmetic material M.

Here, the following describes a state illustrated in FIG. 6 where three pieces of the base parts 4*d* are arranged side by side in the lateral direction as a criterion. The respective support pieces 4*c* having an approximately rectangular parallelepiped shape are disposed at positions heading upward by 45° and positions heading downward by 45° at the respective outer positions on both right and left sides of the base parts 4*d*. The base part sides of the support pieces 4*c* are coupled to the outer surfaces of the base part 4*d*, and the support pieces 4*c* extend forward. The arc-shaped support piece surfaces 4*j* inside these support pieces 4*c* support the outer peripheral surfaces of the rod-shaped cosmetic materials M.

The support piece 14*c* having an approximately regular pentagonal shape is disposed at the upper portion between the one base part 4*d* on one side (for example, the left side) and the base part 4*d* at the center. The base part side of the support piece 14*c* is coupled to the outer surfaces at the upper portions of the adjacent base parts 4*d* and 4*d* and the top surface of the coupling part 4*e*, and the support piece 14*c* extends forward. Similarly, the support piece 14*c* is also disposed on the upper portion between the one base part 4*d* on the other side (for example, the right side) and the base part 4*d* at the center. The one arc-shaped inner support piece surface 4*j* of one piece of this support piece 14*c* supports the outer peripheral surface of the one rod-shaped cosmetic material M, and the other arc-shaped inner support piece surface 4*j* of the support piece 14*c* supports the outer peripheral surface of another rod-shaped cosmetic material M.

The support piece 14*c* is disposed at the lower portion between the one base part 4*d* on one side and the base part 4*d* at the center. The support piece 14*c* forms a shape of inverting an approximately regular pentagonal shape. The base part side of the support piece 14*c* is coupled to the outer surfaces at the lower portions of the adjacent base parts 4*d* and 4*d* and the lower surface of the coupling part 4*e*, and the support piece 14*c* extends forward. Similarly, the support piece 14*c* is also disposed at the lower portion between the one base part 4*d* on the other side and the base part 4*d* at the center. The one arc-shaped inner support piece surface 4*j* of one piece of this support piece 14*c* supports the outer peripheral surface of the one rod-shaped cosmetic material M. The other arc-shaped inner support piece surface 4*j* of the support piece 14*c* supports the outer peripheral surface of the other rod-shaped cosmetic material M.

The outer peripheral surfaces at the rear end portions of the rod-shaped cosmetic materials M bumped against the base parts 4*d* are sandwiched by these mutual support pieces 4*c* and 14*c* arranged side by side circumferentially to support the rod-shaped cosmetic materials M.

Chamfered parts C (see FIG. 5 and FIG. 6) are constructed on the arc-shaped inner peripheral surface sides of the tips of the support pieces 4*c* and 14*c* to function as guide surfaces when the rod-shaped cosmetic materials. M are pushed into. Alternatively, ribs (claws) extending in the axial direction may be disposed upright on the inner peripheral surfaces of the support piece surfaces 4*j* illustrated in FIG. 6 to enhance an adhesive power by causing the rod-shaped cosmetic materials M to sink into these ribs.

As illustrated in FIG. 1, FIG. 2, FIG. 4, and FIG. 5, the coupling shaft part 4*f* continuous with the supporting part 4*a* is configured to be long, and convex rotation engaging parts 4*h* and 4*h* are protruded opposed to one another at the rear end portion of the rotation stopper 4*g* continuous with the coupling shaft part 4*f*. As illustrated in FIG. 2, the rotation engaging parts 4*h* enter into long grooves 3*c*, which are disposed so as to extend in the axial direction at the inner peripheral surfaces of the joint 3. The rotation engaging parts 4*h* are coupled to be movable in the axial direction and unrotatable around the axis line, thus functioning as rotation stoppers at a screwing action. The positions illustrated in FIG. 2 where the rotation engaging parts 4*h* bump against the top end surfaces of the long grooves 3*c* are configured as the advance limit of the rod-shaped cosmetic material supporting body 4.

As illustrated in FIG. 1 to FIG. 4 and FIG. 8, at the leading tube 1, three pieces of rod-shaped cosmetic material holes 1*c* are arranged side by side. The rod-shaped cosmetic material holes 1*c* extend rearward from an opening 1*b* at the tip and pass through the leading tube 1 such that the rod-shaped cosmetic materials M slide through the rod-shaped cosmetic material holes 1*c*. Here, the opening 1*b* is not divided into three parts and the rod-shaped cosmetic material holes 1*c* are coupled to one another via clearances at the opening 1*b*. However, the respective rod-shaped cosmetic material holes 1*c* constituting the opening 1*b* need not to be coupled to one another but may be separated.

As illustrated in FIG. 1, FIG. 3, and FIG. 7, the leading tube 1 has support piece grooves 1*d* on which the plurality of support pieces 4*c* advance and retreat, support piece grooves 11*d* on which the plurality of support pieces 14*c* advance and retreat, and coupling part holes 1*m* through which the coupling parts 4*e* illustrated in FIG. 6 advance and retreat. The support piece grooves 1*d*, the support piece grooves 11*d*, and the coupling part holes 1*m* are installed consecutively from parts near the tips of the rod-shaped cosmetic material holes 1*c*. Here, the support piece grooves 1*d* and 11*d* and the coupling part holes 1*m* form a supporting part hole 1*n* in which the supporting part 4*a* advances and retreats, and the supporting part hole 1*n* and the rod-shaped cosmetic material holes 1*c* form a shape of an advance/retreat hole 1*r* illustrated in FIG. 7. While the rod-shaped cosmetic material holes 1*c* are formed from the tip of the leading tube 1, the supporting part hole 1*n* is formed from the part near the tip of the leading tube 1 to the inside of the tip end of the joint 3 within the advance and retreat range that the supporting part 4*a* advances and retreats in the axial direction (see FIG. 1).

After the assembly of the container, the plurality of rod-shaped cosmetic materials M are inserted from the tip side of the leading tube 1 to obtain the rod-shaped cosmetic material feeding container 100 illustrated in FIG. 1. While the leading tube 1 and the joint 3 are dividedly manufactured and coupled together to be integrated to reduce a sink mark here, the leading tube 1 and the joint 3 may be an integrally molded product.

With the use of such rod-shaped cosmetic material feeding container 100, the relative rotation (the rotating operation) of the leading tube 1 and the holder tube 2 in one direction, a feed direction, causes the screwing action by the male screw 4*i* of the rod-shaped cosmetic material supporting body 4 and the screw projections 5*i* and 5*i* of the female screw member 5. The screwing action causes the rod-shaped cosmetic material supporting body 4 to advance, and the plurality of rod-shaped cosmetic materials M appear from the opening 1*b* at the tip of the leading tube 1 and can be used for the application (see FIG. 2). When the application is terminated and the user relatively rotates (the rotating operation) the leading tube 1 and the holder tube 2 in a feedback direction, which is a direction opposite to the one direction, the rod-shaped cosmetic material supporting body 4 retreats and the plurality of rod-shaped cosmetic materials M sink into the opening 1*b* at the tip of the leading tube 1.

With such rod-shaped cosmetic material feeding container 100, the plurality of support pieces 4*c* and 14*c*, which are disposed at the supporting part 4*a*, support the plurality of rod-shaped cosmetic materials M arranged side by side (parallel) in the container. Additionally, the plurality of rod-shaped cosmetic materials M simultaneously advance and retreat in the axial direction together with the supporting part 4*a* and the plurality of rod-shaped cosmetic materials M can appear and disappear from the opening 1*b* at the tip of the leading tube 1, thus provided for the application. Therefore, when a cosmetic material is applied over the applied portion such as an eyebrow, the plurality of rod-shaped cosmetic materials M allow the efficient application of the cosmetic material, and, for example, the one rod-shaped cosmetic material M ensures selective, fine makeup. Moreover, the rod-shaped cosmetic materials M do not cause, for example, a clogging of the cosmetic material such as the liquid cosmetic material, and the cosmetic material does not become blurred and is always properly applicable. Additionally, the plurality of rod-shaped cosmetic materials M serve as a comb and ensure the makeup while the applied portion is combed. Further, although the plurality of rod-shaped cosmetic materials M are provided, the rod-shaped cosmetic material feeding container 100 is easy to be carried around. Furthermore, the rod-shaped cosmetic material feeding container 100 that can feed/feed back the plurality of rod-shaped cosmetic materials M and features good usability can be provided. Since the plurality of rod-shaped cosmetic materials M are individually supported by the one shared support piece 14*c*, the configuration of the supporting part 4*a* can be simplified.

Specifically, the one support piece 14*c* includes the one support piece surface 4*j*, which supports a part of the outer surface of the one rod-shaped cosmetic material M, and the other support piece surface 4*j*, which supports a part of the outer surface of the other rod-shaped cosmetic material M adjacent to the one rod-shaped cosmetic material M. Therefore, the one support piece 14*c* can individually support the plurality of adjacent rod-shaped cosmetic materials M and therefore the configuration of the supporting part 4*a* can be simplified.

With this embodiment, the supporting part 4*a* includes the base parts 4*d*, the coupling parts 4*e*, and the plurality of support pieces 4*c* and 14*c*. The respective rod-shaped cosmetic materials M bump against the base parts 4*d*. The coupling parts 4*e* couple the adjacent base parts 4*d* and 4*d* together. The plurality of support pieces 4*c* and 14*c* extend forward from the outer surfaces of the base parts 4*d* and the coupling parts 4*e*. The base parts 4*d* are configured to advance and retreat through the rod-shaped cosmetic material holes 1*c*, the support pieces 4*c* and 14*c* and the coupling parts 4*e* are configured to advance and retreat through the supporting part hole 1*n*, and the base parts 4*d* and 4*d* are coupled to one another via the coupling parts 4*e*; therefore, the strength of the supporting part 4*a* can be increased.

With this embodiment, the rod-shaped cosmetic material holes 1*c* have the approximately similar shape to the outer shape of the rod-shaped cosmetic materials M, and the opening 1*b* on the leading tube 1 has the shape corresponding to the shape of the rod-shaped cosmetic material holes 1*c* arranged by the count identical to the count of rod-shaped cosmetic materials M supported by the support pieces 4*c* and 14*c*. Accordingly, the rod-shaped cosmetic material M is not limited to have the columnar shape but is also applicable to a non-circular cross-sectional shape such as an ellipsoidal cross-sectional surface.

With this embodiment, the opening 1*b* is configured by coupling the plurality of rod-shaped cosmetic material holes 1*c* together with the clearances between them. This configuration allows disposing the rod-shaped cosmetic materials M as close to each other as possible (that is, disposing the rod-shaped cosmetic materials M in the state where the clearances are provided to the extent so as not to bring the rod-shaped cosmetic materials M in contact with one another). For example, when the cosmetic material is applied over an eyebrow or a similar part, the cosmetic material can be drawn densely to the hair of the eyebrow. In the case where the rod-shaped cosmetic materials M are in contact with one another and an application as one rod-shaped cosmetic material is performed, the makeup possibly finishes like daubing. However, since the clearances are interposed between the mutual rod-shaped cosmetic materials M as described above, this embodiment ensures preventing a sense of daubing. In the case where the rod-shaped cosmetic material holes 1*c* are not coupled to one another but the respective rod-shaped cosmetic material holes 1*c* are separated, partition plates or similar members are required at the coupling parts 4*e*. Incidentally, to produce the leading tube 1 by metallic molding, a core pin is used to mold the part of the opening 1*b*. To mold the opening 1*b* in which the plurality of rod-shaped cosmetic material holes 1*c* are coupled to one another via the clearances between them, one thick core pin is usable and the strength of the core pin can be strengthened, which is more preferable.

With this embodiment, the plurality of rod-shaped cosmetic materials M configured to have individually different colors ensures easily forming color unevenness where colors are not uniform on the applied portion.

In the case where the applied portion is an eyebrow and the makeup is put on the eyebrow with one thin rod-shaped cosmetic material (an eyebrow pencil), putting on the makeup on the entire eyebrow requires the time. When the makeup is put on the eyebrow with the one thick rod-shaped cosmetic material, the makeup looks like being filled, requiring the technique and the time to put on the fine, dainty makeup. However, with this embodiment, since the plurality of rod-shaped cosmetic materials can be simultaneously used, application clearances like the eyebrow with naturally partial fallen out can be easily generated. Accordingly, the dainty and beautiful application while drawing the natural eyebrow can be performed in a short time. Incidentally, for example, to draw a thin part, for example, an end of an eyebrow, one of the plurality of rod-shaped cosmetic materials may be used.

With this embodiment, the rod-shaped cosmetic materials M can sink into the container. This eliminates a need for a cap to prevent volatilization like a liquid cosmetic material extruding container and therefore can achieve the compact container compared with the liquid cosmetic material extruding container.

With the above-described embodiment, the coupling parts 4*e* of the supporting part 4*a* may be eliminated, the respective inner peripheral surfaces on the base part side of the center support piece. 14*c* at the center may be coupled to the outer peripheral surfaces of the base parts 4*d*, the support piece 14*c* may be extended forward from the base parts 4*d*, and the rear portions of the rod-shaped cosmetic materials M may be supported from the peripheral areas by these extending parts. In this case, the coupling part hole may be omitted at the leading tube 1. Additionally, the support pieces are changed such that the coupling parts 4*e* are eliminated, the base part sides of the respective upper and lower support pieces 14*c* at the center are each extended to the opposite upper and lower support pieces 14*c* and are coupled to one another, and thus the support pieces having approximately semicircular inner peripheral surfaces disposed back to back are formed. The approximately semicircular inner peripheral surfaces of these support pieces may be coupled to the respective outer peripheral surfaces of the base parts 4*d*, the support pieces having the approximately semicircular inner peripheral surfaces integrated with the base parts 4*d* one above the other may be extended forward, and these respective extending parts may support the rear portions of the adjacent rod-shaped cosmetic materials from the peripheral area.

While the present invention has been specifically described based on the embodiment, the present invention is not limited to the above-described embodiment. For example, the above-described embodiment describes that the eyebrow pencil is preferable because the operations and the effects are especially remarkable as described above. Meanwhile, the present invention can be used as, for example, an eye liner and an eye shadow by changing respective colors of rod-shaped cosmetic materials and can be used for a gradation by shading off the respective colors. Additionally, the rod-shaped cosmetic materials with an identical color are usable as, for example, hair dye.

Further, while the above-described embodiment describes the application of the three rod-shaped cosmetic materials M as especially preferable, as long as the number of the rod-shaped cosmetic materials M is two or more, the present invention is applicable.

The number of support pieces is also not limited to that of the above-described embodiment.

The positions of the rod-shaped cosmetic materials M arranged side by side are not limited to be configured like rows but may be, for example, arranged side by side so as to form a stagger shape, a triangular shape, a quadrangular shape, and a round shape. In short, the plurality of rod-shaped cosmetic materials M only need to be arranged such that the axis centers are parallel to one another. The rod-shaped cosmetic materials M may have different thicknesses.

It is only necessary that the male screw and the female screw work similar to a screw thread like a group of projections intermittently disposed or a group of projections spirally and intermittently disposed in the above-described embodiment. Alternatively, the screw projections may be a continuous screw thread.

The rod-shaped cosmetic material feeding container 100 of the above-described embodiment is also usable as a rod-shaped cosmetic material cartridge. In this case, the rear half portion of the above-described rod-shaped cosmetic material cartridge 100 is inserted in a long cartridge housing container having a cylindrical shape with a closed bottom for use. Specifically, as the engagement parts engageable in the rotation direction, for example, a plurality of protrusions extending in the axial direction are circumferentially arranged on the inner peripheral surface of the cartridge housing container. Additionally, a plurality of protrusions that extend in a front-rear direction and enter between the mutual protrusions of the cartridge housing container to engage with the protrusions in a rotation direction are circumferentially arranged on the outer peripheral surface of the holder tube 2 constituting the rod-shaped cosmetic material cartridge 100. Additionally, for example, as the engagement part engageable in the axial direction, for example, a circular concave part or a circular convex part is arranged at the inner peripheral surface of the cartridge housing container, and a convex part or a concave part into which the concave part or the convex part of the cartridge housing container enters is formed on the outer peripheral surface of the holder tube 2. Then, the rod-shaped cosmetic material cartridge 100 is inserted into the cartridge housing container from the rear end portion, and the holder tube 2 is configured to be synchronously rotatable with respect to the cartridge housing container by the above-described engagement parts engaging with one another in the rotation direction. Additionally, with the above-described engagement parts engaging with one another in the axial direction, a rod-shaped cosmetic material feeding container where the holder tube 2 is coupled to the cartridge housing container to be removably (or undetachably) attached to the cartridge housing container can be configured. In this case, the holder tube 2 and the cartridge housing container constitute the rear portion of the container. The configuration of the engagement part is not limited to the above-described protrusion and concave and convex parts.

REFERENCE SIGNS LIST

1 . . . leading tube (front portion of a container), 1*b* . . . opening, 1*c* . . . rod-shaped cosmetic material hole, 1*d*, 11*d* . . . support piece groove, 1*m* . . . coupling part hole, 1*n* . . . supporting part hole, 1*r* . . . advance/retreat hole, 2 . . . holder tube (rear portion of the container), 3 . . . joint (front portion of the container), 4 . . . rod-shaped cosmetic material supporting body (movable body), 4*a* . . . supporting part, 4*c*, 14*c* . . . support piece, 4*d* . . . base part, 4*e* . . . coupling part, 4*i* . . . male screw, 4*j* . . . support piece surface, 5 . . . female screw member, 5*i* . . . female screw, 100 . . . rod-shaped cosmetic material feeding container, M . . . rod-shaped cosmetic material (eyebrow pencil)

What is claimed is:

1. A rod-shaped cosmetic material feeding container comprising:

a tubular container that has a front portion of the container and a rear portion of the container;

a movable body configured to be unrotatable around an axis line and movable in an axial direction with respect to the front portion of the container, the movable body including a supporting part configured to support a rod-shaped cosmetic material at a tip, the movable body including a male screw at an outer peripheral portion; and a female screw member configured to be rotatable around the axis line with respect to the front portion of the container, the female screw member including a female screw for screw engagement with the male screw at an inner peripheral portion, wherein relative rotation of the front portion of the container and the rear portion of the container causes a screwing action by the male screw and the female screw, the screwing action causing the movable body to advance and retreat, whereby the rod-shaped cosmetic material appears and disappears from an opening at the tip of the container, the supporting part includes a plurality of support pieces, the plurality of support pieces supporting rear portions of the plurality of rod-shaped cosmetic materials from a peripheral area, the supporting part arranging the plurality of rod-shaped cosmetic materials side by side such that axis centers of the plurality of rod-shaped cosmetic materials are parallel to one another while the plurality of rod-shaped cosmetic materials are separated from one another, the front portion of the container has rod-shaped cosmetic material holes and a supporting part hole, the rod-shaped cosmetic material holes being configured such that the plurality of rod-shaped cosmetic materials advance and retreat through the rod-shaped cosmetic material holes, the supporting part hole being configured such that the supporting part including the support pieces advances and retreats through the supporting part hole, the opening is disposed corresponding to the plurality of rod-shaped cosmetic material holes, and the support pieces individually support the plurality of rod-shaped cosmetic materials.

2. The rod-shaped cosmetic material feeding container according to claim 1, wherein the support pieces have inner surfaces as support piece surfaces, the support piece surfaces supporting a part of outer surfaces of the rod-shaped cosmetic materials, and one support piece has:

one support piece surface that supports a part of an outer surface of one rod-shaped cosmetic material; and another support piece surface that supports a part of an outer surface of another rod-shaped cosmetic material adjacent to the one rod-shaped cosmetic material.

3. The rod-shaped cosmetic material feeding container according to claim 2, wherein the supporting part includes:

base parts against which the respective rod-shaped cosmetic materials bump;

coupling parts that couple the adjacent base parts together; and the plurality of support pieces that extend forward from outer surfaces of the base parts and the coupling parts, the base parts advance and retreat through the rod-shaped cosmetic material holes, and the support pieces and the coupling parts advance and retreat through the supporting part hole.

4. The rod-shaped cosmetic material feeding container according to claim 3, wherein the opening on the front portion of the container has a shape corresponding to a shape of the rod-shaped cosmetic material holes arranged by a count identical to a count of rod-shaped cosmetic materials supported by the support pieces, the rod-shaped cosmetic material holes having an approximately similar shape to an outer shape of the rod-shaped cosmetic materials.

5. The rod-shaped cosmetic material feeding container according to claim 4, wherein the plurality of rod-shaped cosmetic material holes are coupled to one another via clearances at the opening.

6. The rod-shaped cosmetic material feeding container according to claim 2, wherein the opening on the front portion of the container has a shape corresponding to a shape of the rod-shaped cosmetic material holes arranged by a count identical to a count of rod-shaped cosmetic materials supported by the support pieces, the rod-shaped cosmetic material holes having an approximately similar shape to an outer shape of the rod-shaped cosmetic materials.

7. The rod-shaped cosmetic material feeding container according to claim 6, wherein the plurality of rod-shaped cosmetic material holes are coupled to one another via clearances at the opening.

8. The rod-shaped cosmetic material feeding container according to claim 1, wherein the supporting part includes:

base parts against which the respective rod-shaped cosmetic materials bump;

coupling parts that couple the adjacent base parts together; and the plurality of support pieces that extend forward from outer surfaces of the base parts and the coupling parts, the base parts advance and retreat through the rod-shaped cosmetic material holes, and the support pieces and the coupling parts advance and retreat through the supporting part hole.

9. The rod-shaped cosmetic material feeding container according to claim 8, wherein the opening on the front portion of the container has a shape corresponding to a shape of the rod-shaped cosmetic material holes arranged by a count identical to a count of rod-shaped cosmetic materials supported by the support pieces, the rod-shaped cosmetic material holes having an approximately similar shape to an outer shape of the rod-shaped cosmetic materials.

10. The rod-shaped cosmetic material feeding container according to claim 9, wherein the plurality of rod-shaped cosmetic material holes are coupled to one another via clearances at the opening.

11. The rod-shaped cosmetic material feeding container according to claim 1, wherein the opening on the front portion of the container has a shape corresponding to a shape of the rod-shaped cosmetic material holes arranged by a count identical to a count of rod-shaped cosmetic materials supported by the support pieces, the rod-shaped cosmetic material holes having an approximately similar shape to an outer shape of the rod-shaped cosmetic materials.

12. The rod-shaped cosmetic material feeding container according to claim 11, wherein the plurality of rod-shaped cosmetic material holes are coupled to one another via clearances at the opening.

13. The rod-shaped cosmetic material feeding container according to claim 1, wherein the plurality of rod-shaped cosmetic materials have individually different colors.

14. The rod-shaped cosmetic material feeding container according to claim 1, wherein the rod-shaped cosmetic materials are eyebrow pencils.

* * * * *